US005641242A

United States Patent [19]

Riviere

[11] Patent Number: 5,641,242

[45] Date of Patent: Jun. 24, 1997

[54] APPARATUS FOR STORING A BOAT

[76] Inventor: Rhett C. Riviere, 785 Grace Ave., Aiken, S.C. 29801

[21] Appl. No.: 511,359

[22] Filed: Aug. 4, 1995

[51] Int. Cl.[6] ..... B63C 3/02; C02B 3/20

[52] U.S. Cl. ..... 405/3; 405/7; 114/263

[58] Field of Search ..... 405/3, 7; 114/44, 114/45, 46, 47, 48, 263

[56] References Cited

U.S. PATENT DOCUMENTS

| | | | |
|---|---|---|---|
| 2,821,315 | 1/1958 | Bucher | 414/477 |
| 3,191,389 | 6/1965 | Poe | 405/3 |
| 3,227,292 | 1/1966 | Jacobs | 405/1 |
| 3,380,607 | 4/1968 | Dale | 414/477 |
| 3,753,355 | 8/1973 | Knoch | 405/3 |
| 3,857,248 | 12/1974 | Rutter | 114/45 X |
| 4,037,421 | 7/1977 | Whitley, Jr. | 61/65 |
| 4,222,698 | 9/1980 | Boelter | 414/477 |
| 4,286,906 | 9/1981 | Robertson | 414/477 |
| 4,601,606 | 7/1986 | Eason | 405/1 |
| 5,163,378 | 11/1992 | Raymond | 114/44 |
| 5,184,913 | 2/1993 | Meriwether | 405/1 |
| 5,460,112 | 10/1995 | Travioli | 405/7 X |

*Primary Examiner*—Tamara L. Graysay
*Assistant Examiner*—Tara L. Mayo
*Attorney, Agent, or Firm*—Michael A. Mann, P.A.

[57] ABSTRACT

An apparatus for removing a boat from water and storing in a position above water includes a stationary frame with a pivoting frame attached thereto. An end of the pivoting frame extends into the water, allowing engagement with a boat. The stationary frame is secured to the side of a floating dock or marina so that it extends laterally therefrom. Flotation devices keep the stationary frame level with the dock or marina when not storing a boat, while minimizing the amount of tilt by the dock or marina when a boat is in the stored position. Angled rollers positioned on the pivoting and stationary frame guide the boat to a central position. An alternative preferred embodiment has the stationary frame secured to pilings by a plurality of rings that slidingly fit thereover.

17 Claims, 4 Drawing Sheets

68
70
72
84
96
88
88
86
88
88
92
80
98
100
82
94
74
66

APPARATUS FOR STORING A BOAT

BACKGROUND OF THE INVENTION

1. Field of the Invention

The present invention relates to an apparatus for storing a boat. More specifically, the invention relates to an apparatus for removing a boat from a body of water and for storing the boat a distance above the body of water.

2. Discussion of Background

Various devices are known in the art of boating for removing and storing a boat. What follows is a review of the art's current state.

U.S. Pat. No. 5,163,378 teaches a ground supported device for removing a boat from water that is based on the use of leverage and a hand operated winch. The device is positioned under the back of the boat in a vertical orientation, then rotated downward, leveraging the rear of the boat up onto the cross bar.

U.S. Pat. No. 4,601,606 sets forth a floating boat house that has a carriage extending beyond the house and into the water so that the boat can be driven partially onto the extension. A winch, connected to the carriage, pulls the boat past the pivot point near the edge of the house.

U.S. Pat. No. 3,227,292 teaches a stationary boat ramp wherein a winch cable is used to pull the boat directly onto the device.

U.S. Pat. No. 4,286,906 discloses a trailer having a two-part tilting frame, a winch, and a roller at the end, over which the boat rides when first pulled from the water.

U.S. Pat. No. 5,184,913 sets forth a system to remove a small watercraft from a body of water. The frame is one piece, having a winch and a pivot point to move the craft from the water to the surface of a dock.

U.S. Pat. No. 3,753,355 pivots a boat out of the water with a winch, using a submerged base to anchor and support a pivoting frame.

There is a need for an apparatus for supporting a boat in a position above water that can be used in combination with a floating dock or a marina.

SUMMARY OF THE INVENTION

According to its major aspects and briefly stated, the present invention is an apparatus for removing a boat from water and subsequently storing the boat in a position above the water. The apparatus comprises a horizontal stationary frame with a pivoting frame mounted thereon. The pivoting frame rotates about a horizontal axis and includes a heavier end which extends beyond the stationary frame and into the water, thereby allowing engagement with the bow of an approaching boat. Rollers, carried by both the pivoting and stationary frames, facilitate movement of the boat onto the pivoting frame and are angled to urge the boat toward a centering line. A winch, carried by the stationary frame, pulls the boat onto the pivoting frame.

In one embodiment, the stationary frame extends laterally from a floating dock or from the deck or decks of a marina and is secured thereto. Floats, carried by the stationary frame, maintain the apparatus above water level and minimize tilting of the floating dock or marina when a boat is being pulled onto the device. The stationary frame is optionally provided with decking on the side opposite the floating dock, thereby providing a work area for maintenance of that side of the boat. Additionally, decking or other surface may be provided on one end of the stationary frame for convenience in operating the winch. In an alternative preferred embodiment, the stationary frame is secured to at least one piling by means of a ring fitted to slide thereover. Flotation devices, carried by the stationary frame, maintain the apparatus above the water level.

The cooperation of the present apparatus with a floating dock is an important feature of the present invention. In tidal regions, most boats are kept at floating docks. Attaching the present apparatus to the side of a floating dock to enable the boat owner to store the boat out of water at his dock or his part of the dock is a significant advantage. Many floating docks are located on private property or small marinas, where the capability of routinely lifting a boat out of the water is not available. Furthermore, the boat owner may be paying for a slip at a marina where dry storage for a boat may be available but only for an additional charge. Finally, the present invention enables the owner to work on his boat when it is out of the water, whereas that is not possible at most dry-boat-storage facilities at marinas.

Another important feature of the preferred embodiment of the present invention is the combination of the securement to a floating dock or a marina and the flotation devices. Securing one side of the stationary frame to the dock or marina prevents lateral movement of the stationary frame. Moreover, the dock or marina acts in part as a load-accepting surface. In so doing, less buoyancy is required of the flotation devices to keep the stationary frame afloat with and without the boat on it. Thus, the flotation devices may be properly sized so that, when not supporting a boat, the stationary frame remains level with the dock or marina, and when receiving a boat for storage or storing the boat, the amount of tilt of the dock or marina is minimized.

Another significant feature of the present invention is the pivoting frame that extends into the water. This feature enables a boat to be pulled onto the apparatus without being lifted onto it first. Moreover, as the boat is pulled up the pivoting frame by the winch, the frame will rotate about the pivoting axis from the shifting of the weight of the boat itself, thereby requiring less force to move the boat to its desired storage position.

Another significant feature of the present invention is the angled rollers carried by both the stationary and pivoting frame to guide the boat onto the apparatus. The rollers are made of a cushioned, non-abrasive material to prevent damage to the boat. Positioned in pairs, the rollers act to cushion the boat, while facilitating its movement onto the pivoting frame. Moreover, the rollers are angled to conform to the dimensions of the bottom of the boat and thereby urge the boat toward a central, stable position.

An additional feature, which is part of the alternative embodiment of the invention, is the rings fitted to slide over the pilings. The rings prevent the stationary frame from lateral movement, but allow vertical movement. This in turn enables the stationary frame to remain above water despite changing tides and water levels.

Other features and their advantages will be apparent to those skilled in the art from a careful reading of the Detailed Description of Preferred Embodiments accompanied by the following drawings.

DETAILED DESCRIPTION OF A PREFERRED EMBODIMENT

Figure 1:
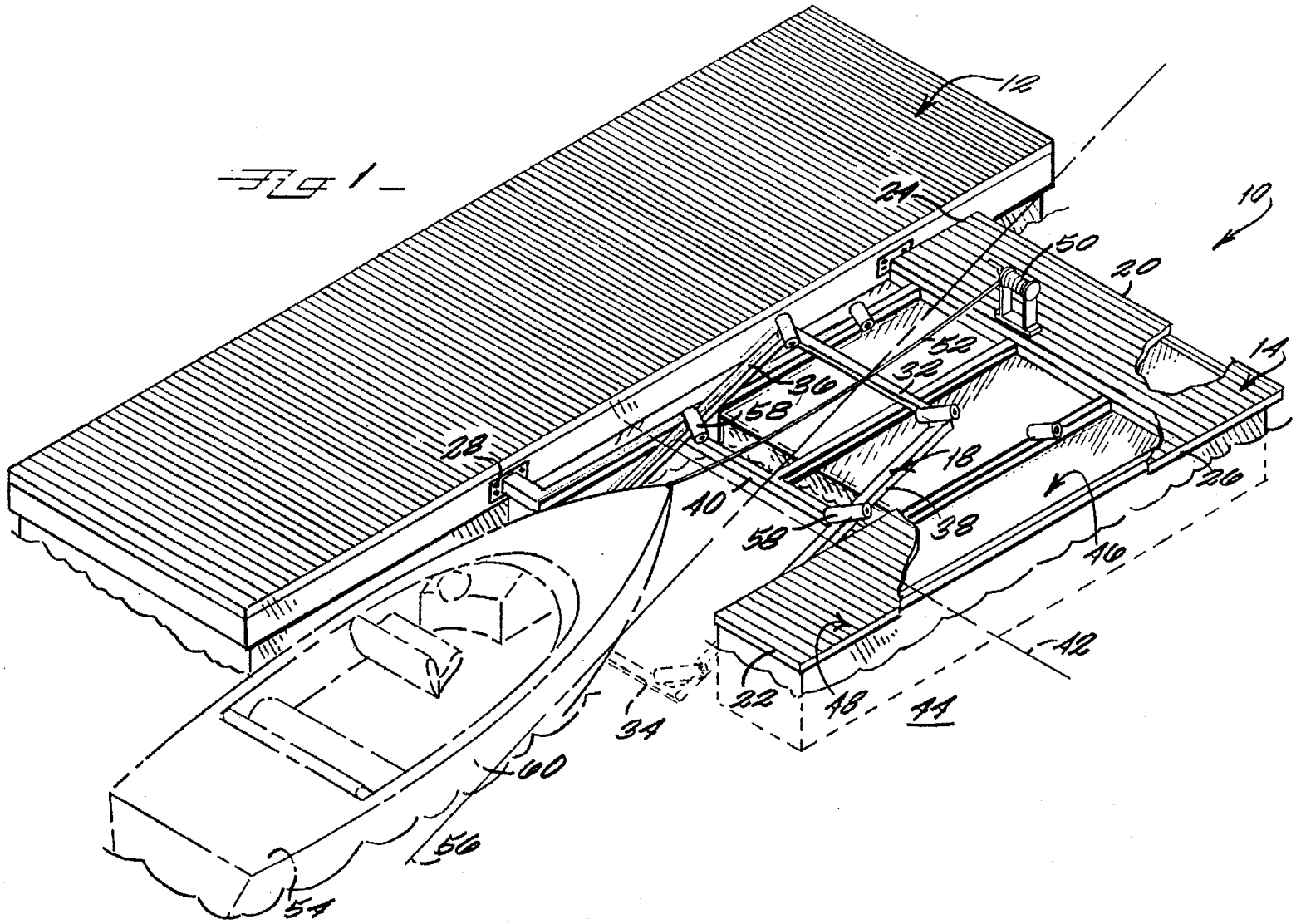
FIG. 1. is a perspective view of an apparatus according to a preferred embodiment of the present invention shown in use with a floating dock.

The present invention is an apparatus for lifting a boat from water and storing the boat in a stable position above water next to a floating dock. The apparatus is to be used in conjunction with a floating dock and to cooperate with the floating dock. In particular, it will extend laterally from the dock and derive a part of its support from it.

Referring now to FIGS. 1 through 3*b*, a preferred embodiment of an apparatus according to the present apparatus, generally indicated by reference numeral 10, is shown secured to, and extending laterally from, a floating dock 12. Apparatus 10, when secured to floating dock 12, will be positioned beside and proximate to floating dock 12 so that an individual can step from floating dock 12 onto apparatus 10 and vice versa. As used herein, a "floating dock" means any type of wharf or platform that is positioned on a body of water by means of suspension or flotation so that the floating dock rises and falls with the water level.

Apparatus 10 comprises a stationary frame 14 and a pivoting frame 18 attached thereto. Stationary and pivoting frames 14, 18, are simple frames made of a suitably rigid and strong material, preferably corrosion resistant, such as channel or angle steel members painted or coated with a polymer. Stationary frame 14 has a first end 20, an opposing second end 22, a first side 24 and an opposing second side 26. First side 24 of stationary frame 14 is secured to floating dock 12 by any convenient means such as by bolting an end plate 28, as shown, or by a flexible or hinged connection such as a hinged joint, and may be connected to the side of floating dock 12, as shown, or to its underside. Second end 22 of stationary frame 14 is recessed to receive pivoting frame 18. Near the middle of stationary frame 14 is preferably a cross bar 40 for stiffening.

Pivoting frame 18 has a first end 32, an opposing second end 34, a first side 36 and an opposing second side 38. First and second sides, 36 and 38, of pivoting frame 18 are essentially parallel to first and second sides, 24 and 26, of stationary frame 14. The first end 32 of pivoting frame 18 extends beyond second end 22 of stationary frame 14; the second end of pivoting frame 18 is received into the recess formed beginning at second end 22 of stationary frame 14.

Pivoting frame 18 pivots about a horizontal axis of rotation 42 that is located so that, when pivoting frame 18 is free to pivot, first end 32 goes up slowly and second end 34 goes down slowly. This condition can be achieved by an off-center pivoting axis or an appropriate weight distribution that slightly favors second end 34, making it heavier.

Stationary and pivoting frames 14, 18, are supported above water 44 by floats 46, which can be made of any material suitable for providing sufficient buoyant force for the weight to be supported, including various foams and plastics, hollow containers, containers filled with foams or plastics, or other conventional flotation material. Floats 46 extend under stationary frame 14 and across part of the recess in stationary frame 14 under pivoting frame 18 between horizontal axis 42 and first end 20 of stationary frame. Preferably, but optionally, decking 48 can be used to provide a suitable surface on stationary frame 14 for standing or walking.

Near first end 20 of stationary frame 14 is a winch 50 for pulling a cable 52 attached to a boat 54. Winch 50 may be manually operated or electrically operated. Pivoting frame 18 has a centerline 56; winch 50 is positioned to pull boat 54 along that centerline 56. To assist winch 50 and cable 52 in centering boat 54, rollers 58 are mounted at an angle on stationary frame 14 and pivoting frame 18 to engage the underside 60 of boat 54 and guide it toward centerline 56 as it moves toward winch 50.

As is illustrated in FIGS. 2*a* and 2*b* and FIGS. 3*a* and 3*b*, when not supporting boat 54, pivoting frame 18 will pivot so that second end 34 is lower than first end 32, and second end 34 is below the level of the water 44. When a user wants to store boat 54, the boat is maneuvered toward second end 34 of pivoting frame 18 and cable 52 is attached to the front of boat 54. By turning winch 50, cable 52 pulls boat 54 up onto pivoting frame 18. When boat 54 has been moved far enough forward, pivoting frame 18 will begin to pivot, with first end 32 falling until pivoting frame 18 is coplanar with stationary frame 14. Stops (not shown) on stationary frame 14 or pivoting frame 18 will limit the rotation of pivoting frame 18, and pins (not shown) can be used to secure the two frames together. As boat 54 is pulled from the water 44, rollers 58 guide it toward centerline 56. There is no need to pull boat 54 farther forward after frames 14 and 18 are coplanar and pinned.

Figure 2A:
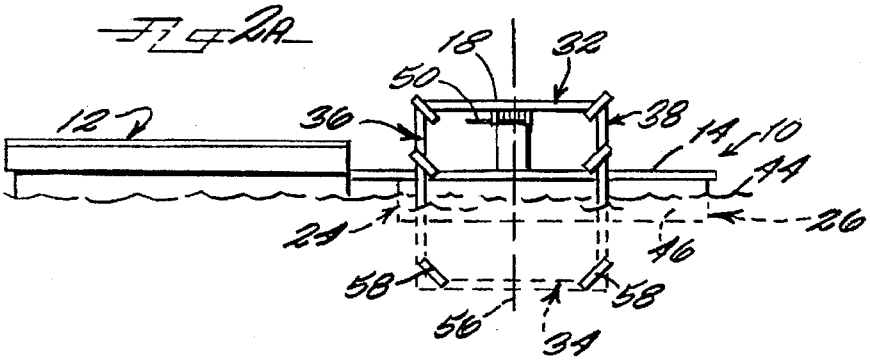
FIG. 2*a* is an end view of the preferred embodiment of the present invention shown in FIG. 1.
Figure 2B:
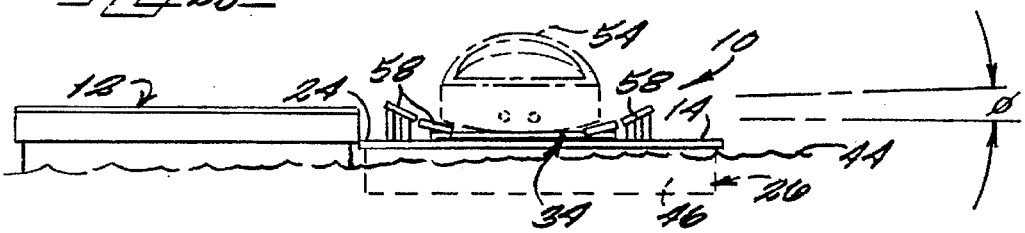
FIG. 2*b* is an end view of the preferred embodiment of the present invention shown in FIG. 1, with a boat shown in a stored position.
Figure 3A:
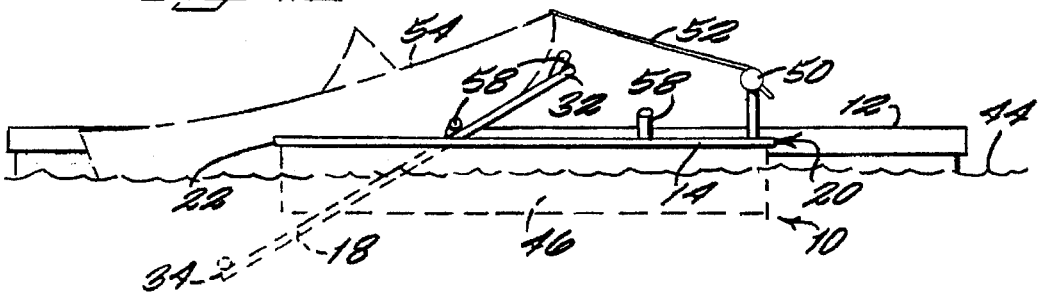
FIG. 3*a* is a side view of the preferred embodiment of the present invention shown in FIG. 1, with a boat engaging the pivoting frame.
Figure 3B:
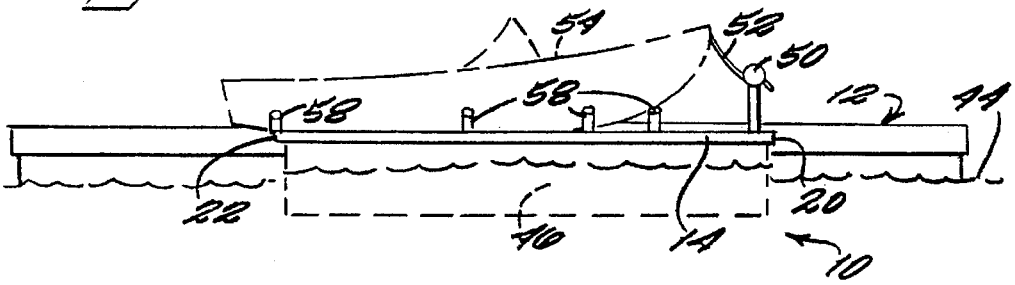
FIG. 3*b* is a side view of the preferred embodiment of the present invention shown in FIG. 1, with a boat in the stored position.

The weight of boat 54 on apparatus 10 is a load borne by both apparatus 10 and floating dock 12, to which apparatus 10 is secured. Furthermore, this load shifts as boat 54 is moved into position on apparatus 10 and lowered into the water 44. It is important to prevent floating dock 12 from listing to such an extent that it would be difficult for people to walk on floating dock 12 or cause any items on dock 12 to fall from it into the water 44. Therefore, floats 46 should be both extensive and buoyant, so that they cover as large an area of water as possible and do not sink very deep with the added weight of boat 54 or rise too much when boat 54 is lowered into the water 44. Because apparatus 10 is secured to floating dock 12, part of the load is shared by floating dock 12. It is to be appreciated that the flotation provided by floats 46 can be engineered once the weight and size of the apparatus and boat are known and the requisite buoyancy provided accordingly. As shown in FIG. 2*b*, apparatus 10 is engineered so that when boat 54 is in the stored position atop stationary frame 14, the angle of tilt, Ø, experienced by floating dock 12 is not greater than 5°, preferably not greater than 3°. When boat 54 is not in the stored position, floats 46 exert sufficient buoyant force to maintain a substantially coplanar orientation of stationary frame 14 with respect to floating dock 12.

Decking 48 is preferably a standard marine-grade, treated wood. Rollers 58 are preferably made of cushioned, non-abrasive, corrosion resistant material so as not to abrade underside 60 of boat 54.

Figure 4:
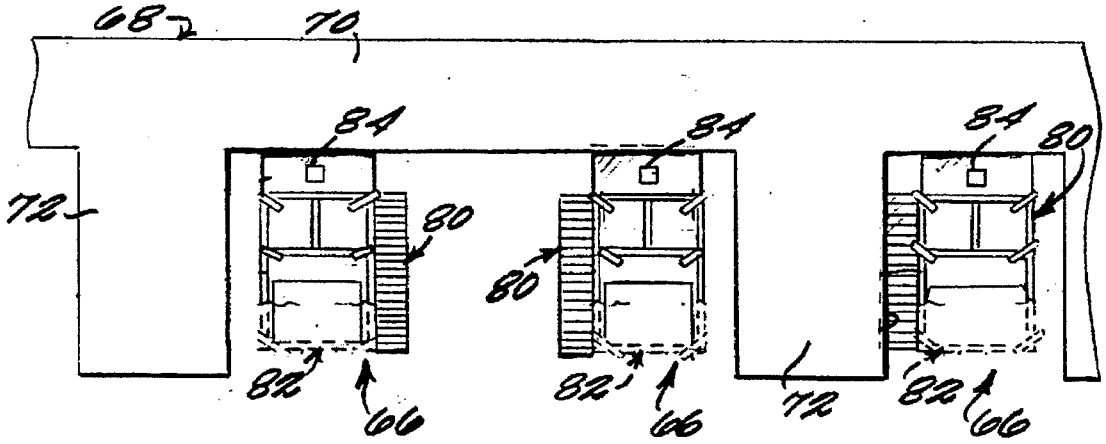
FIG. 4 is a top view of an apparatus according to an alternative preferred embodiment of the present invention, shown in use with a marina.
Figure 5:
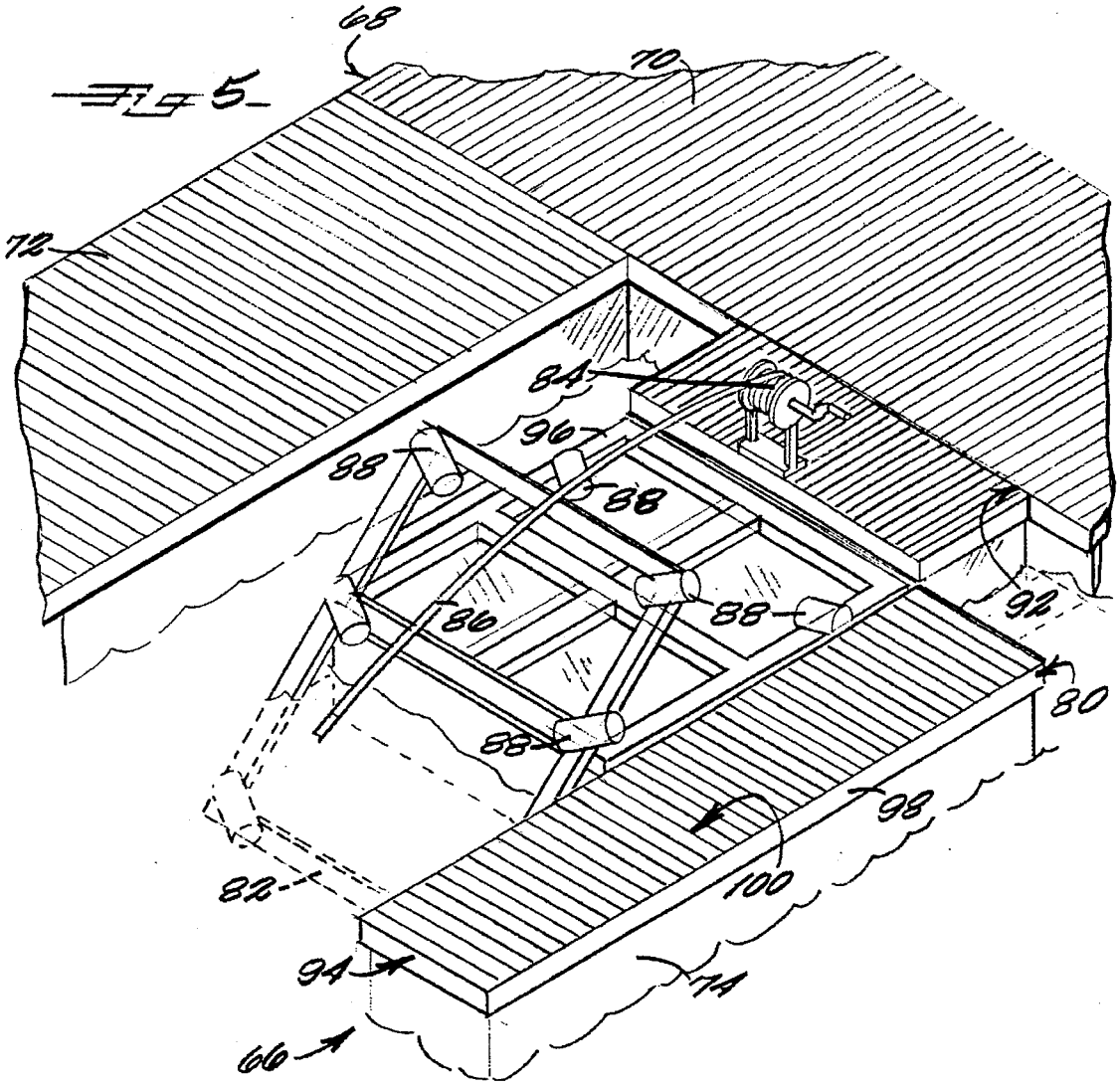
FIG. 5 is a perspective view of an apparatus according to an alternative preferred embodiment of the present invention, shown in use with a marina.

Referring now to FIG. 4 and FIG. 5, there is shown an alternative preferred embodiment of an apparatus according to the present invention, generally indicated by reference numeral 66 and shown in use with a marina 68. As used herein, the term "marina" includes a primary walkway or primary deck 70 with a series of smaller walkways or secondary decks 72 extending from it and spaced apart from each other, all of which are supported using floats 74 so that the marina 68 rises and falls with the water level. Unlike apparatus 10 which was oriented so that the side of boat 54 was facing floating dock 12, apparatus 66 is oriented so that the bow of a boat is now facing primary deck 70 and the side of the boat is facing a secondary deck 72.

Apparatus 66 is comprised of a stationary frame 80 having a pivoting frame 82 attached thereto. As with apparatus 10, apparatus 66 has a winch 84, a cable 86 and angled rollers 88, and operation of apparatus 66 is identical to operation of apparatus 10. Stationary frame 80 has a first end 92 and an opposing second end 94, a first side 96 and an opposing second side 98. As will be appreciated from FIG. 4, when the slip between secondary decks 72 is wide enough for two boats, the side that is the first side 96 will be either the left side or the right side depending on which side of stationary frame 80 is closer to secondary deck 72. Floats 74 extend under stationary frame 80, including a part of its recessed center portion to the extent possible without interfering with pivoting frame 82. Decking 100 may cover stationary frame 80.

Apparatus 66 is secured to primary and secondary decks, 70, 72, in the same manner as apparatus 10 is secured to floating dock 12; that is, either rigidly by bolting or other convenient means or flexibly by a hinged coupling.

Figure 6:
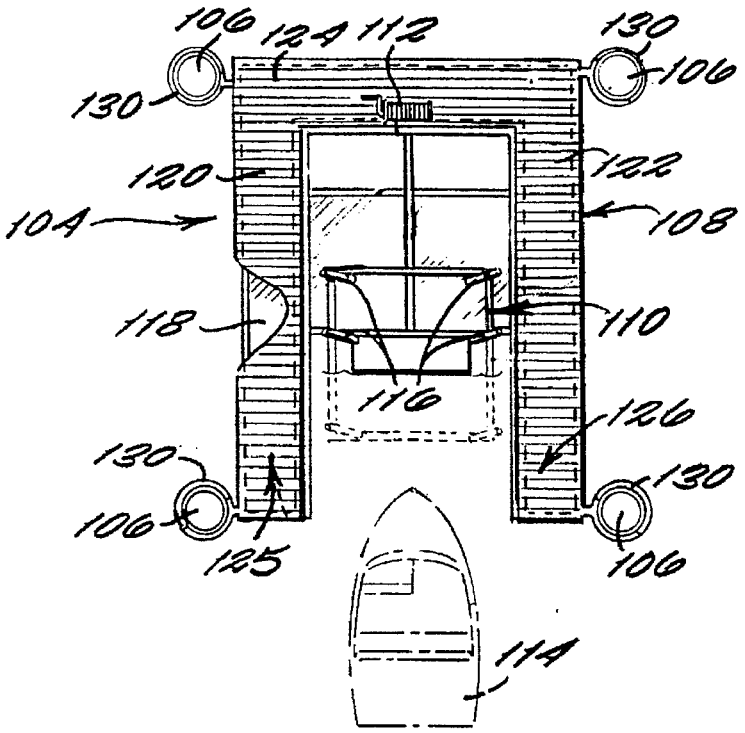
FIG. 6 is a top view of an apparatus according to another alternative preferred embodiment of the present invention, shown in use with a plurality of pilings.

Referring now to FIG. 6, there is shown an additional alternative embodiment of apparatus according to the present invention, generally indicated by reference numeral 104 and shown in use with a plurality of pilings 106. As used herein, the term "piling" means a vertical member or stanchion that resists lateral motion and is partially submerged in a body of water.

Apparatus 104 comprises a stationary frame 108 having a pivoting frame 110 attached thereto. Stationary frame 108 is equipped with a winch 112 which pulls a boat 114 onto pivoting frame 110. Extending from stationary frame 108 and pivoting frame 110 are angled rollers 116 that guide boat 114 onto pivoting frame 110. Stationary frame 108 has a first side 120, an opposing second side 122, a first end 124 on which winch 112 is mounted on a second end 125. Decking 126 covers floats 118 that extend under stationary frame 108 and across part of the recessed center of stationary frame 108.

Apparatus 104 is attached to rings 130 that encircle pilings 106 in such a way that, as the level of the water rises and falls, apparatus 104 rises and falls and rings 130 slip easily up and down pilings 106.

The present apparatus in all three of the disclosed, preferred alternative embodiments is a simple addition to existing docking facilities for those boat owners who prefer to store their boats out of the water at their docks or at slips they rent, without having to obtain separate dry storage. The apparatus operates simply enough so that one person can raise or lower a boat without assistance. The apparatus, moreover, enables the boat owner to have access to all sides of the boat, whether from the dock or from the decking-covered stationary frame.

It will be apparent to those skilled in the art that many modifications and substitutions can be made to the preferred embodiment just described without departing from the spirit and scope of the invention as defined in the appended claims.

What is claimed is:

1. An apparatus for lifting a boat from, and storing above, water, said boat having a bottom surface, said apparatus for use with a floating dock, said apparatus comprising:

a stationary frame having a top surface, a first end and an opposing second end, a first side and an opposing second side, said stationary frame including decking laid on said top surface;

a pivoting frame attached to said stationary frame, said pivoting frame pivoting about a horizontal axis of rotation, said pivoting frame having a first end and an opposing second end;

means for securing said stationary frame to said floating dock so that said stationary frame extends laterally from said floating dock;

means for pulling said boat onto said stationary frame, said pulling means carried by said first end of said stationary frame; and means carried by said stationary frame for floating said stationary frame.

2. The apparatus as recited in claim 1, further comprising centering means for centering said boat on said stationary frame, said centering means carried by said stationary frame and said pivoting frame.

3. The apparatus as recited in claim 1, wherein said stationary frame has a center line, and said apparatus further comprises a plurality of rollers carried by said stationary frame and said pivoting frame, said rollers being adapted to contact said bottom surface of said boat so that said boat is urged toward said center line.

4. The apparatus as recited in claim 1, wherein said floating means prevent said dock from tilting more than 5° when said boat is on said pivoting frame.

5. The apparatus as recited in claim 1, wherein said stationary frame further comprises a crossbar positioned between said first and said second sides of said stationary frame, said crossbar being parallel to said first and said second ends of said stationary frame, wherein said floating means depends from said stationary frame, said floating means positioned between said second end of said stationary frame and said crossbar of said stationary frame and along said second side of said stationary frame.

6. The apparatus as recited in claim 1, wherein said pulling means comprises a winch.

7. An apparatus for lifting a boat from, and storing said boat above, water, said boat having a bottom surface, said apparatus for use with a marina having a primary deck and a plurality of spaced apart secondary decks extending therefrom, said apparatus comprising:

a stationary frame having a top surface, a first end and an opposing second end, and a first side and an opposing second side, said stationary frame including decking laid on said top surface;

a pivoting frame attached to said stationary frame, said pivoting frame pivoting about a horizontal axis of rotation, said pivoting frame having a first end and a second end;

means for securing said stationary frame to said marina so that said stationary frame extends laterally from said marina; and means carried by said stationary frame for pulling said boat onto said stationary frame.

8. The apparatus as recited in claim 7, wherein said stationary frame has a center line, and said apparatus further comprises centering means for center said boat on said center line, said centering means carried by said stationary frame and said pivoting frame.

9. The apparatus as recited in claim 7, wherein said stationary frame has a center line, and said apparatus further comprises a plurality of rollers carried by said stationary frame and said pivoting frame, said rollers being angled to contact said bottom surface of said boat so that said boat is urged toward said center line.

10. The apparatus as recited in claim 7, further comprising means carried by said stationary frame for floating said stationary frame and said pivoting frame.

11. The apparatus as recited in claim 7, further comprising means carried by said stationary frame for floating said stationary frame and said pivoting frame, said flotation means extending along said first side of said stationary frame and said second end of said stationary frame.

12. The apparatus as recited in claim 7, wherein said pulling means is a winch.

13. The apparatus as recited in claim 7, wherein said securing means is adapted to secure said apparatus to said primary deck and one secondary deck of said plurality of secondary decks of said marina.

14. An apparatus for lifting a boat from and storing above water, said apparatus for use with at least one piling having an exterior surface, said apparatus comprising:

a stationary frame having a top surface, a first end and an opposing second end, a first side and an opposing second side, and a center line said stationary frame including decking laid on said top surface;

a pivoting frame attached to said stationary frame, said pivoting frame pivoting about a non-center horizontal axis of rotation, said pivoting frame having a first end and an opposing second end, said second end of said pivoting frame extending beyond said second end of said stationary frame;

means for securing said stationary frame to said at least one piling;

means carried by said stationary frame for pulling said boat onto said stationary frame, said pulling means extending from said first end of said stationary frame; and means carried by said stationary frame for floating said stationary frame and said pivoting frame.

15. The apparatus as recited in claim 14, further comprising centering means for centering said boat on said center line, said centering means positioned on said stationary frame and said pivoting frame.

16. The apparatus as recited in claim 14, wherein said apparatus further comprises a plurality of rollers carried by said stationary frame and said pivoting frame, said rollers being adapted to contact said bottom surface of said boat so that said boat is urged toward said center line.

17. The apparatus as recited in claim 14, wherein said securing means comprises at least one ring dimensioned to slide over said exterior surface of said at least one piling, said securing means allowing vertical movement of said stationary frame, said securing means prohibiting lateral movement of said stationary frame.

* * * * *